United States Patent [19]

Maier et al.

[11] 4,352,430

[45] Oct. 5, 1982

[54] METHOD AND APPARATUS FOR SORTING FOREIGN BODIES FROM MATERIAL ON A MOVING CONVEYOR BELT

[75] Inventors: Maxemin Maier; Heinz Wittkugel, both of Hamburg; Klaus J. Liepelt, Ahrensburg; Jorn Homeier, Henstedt-Ulzburg, all of Fed. Rep. of Germany

[73] Assignee: H.F. & Ph.F. Reemtsma G.m.b.H. & Co., Hamburg, Fed. Rep. of Germany

[21] Appl. No.: 112,594

[22] Filed: Jan. 16, 1980

[30] Foreign Application Priority Data

Jan. 19, 1979 [DE] Fed. Rep. of Germany ..... 2901970

[51] Int. Cl.[3] ..... B07C 5/342

[52] U.S. Cl. ..... 209/577; 209/581; 209/587; 356/425; 358/106

[58] Field of Search ..... 209/564, 565, 576, 577, 209/578, 580, 581, 587, 939; 356/380, 386, 387, 425, 431; 358/106

[56] References Cited

U.S. PATENT DOCUMENTS

| | | | |
|---|---|---|---|
| 3,280,692 | 10/1966 | Milnes et al. | 356/380 |
| 3,580,997 | 5/1971 | Webb et al. | 358/106 |
| 3,901,388 | 8/1975 | Kelly | 209/587 X |
| 3,939,983 | 2/1976 | Asfour | 209/581 |
| 4,122,951 | 10/1978 | Alaminos | 209/587 X |
| 4,134,498 | 1/1979 | Jones et al. | 209/587 X |
| 4,186,836 | 2/1980 | Wassmer et al. | 209/587 X |
| 4,219,277 | 8/1980 | Yaroshuk et al. | 356/431 |
| 4,223,346 | 9/1980 | Neiheisel et al. | 358/106 |
| 4,246,098 | 1/1981 | Conway et al. | 209/587 X |
| 4,262,806 | 4/1981 | Drabs | 209/587 X |

FOREIGN PATENT DOCUMENTS

| | | | |
|---|---|---|---|
| 606639 | 5/1978 | U.S.S.R. | 209/581 |

*Primary Examiner*—Robert J. Spar
*Assistant Examiner*—Edward M. Wacyra
*Attorney, Agent, or Firm*—Cushman, Darby & Cushman

[57] ABSTRACT

In the preferred embodiment of the present invention, a television camera is oriented with respect to a conveyor belt such that the direction of the scanning lines of the television camera are perpendicular to the direction of motion of the conveyor belt. Material containing foreign bodies is introduced on the conveyor belt and passes under the television camera and a light source. The television camera detects the reflected and/or radiant light and produces a video signal in accordance therewith. The image component of the video signal for each of the scanning lines is divided into signal portions. Like signal portions of respective scanning lines are successively integrated in an integration circuit to provide a non-zero signal when a foreign body is detected by the television camera. The output of the integration circuit is applied to a threshold switch, which produces a logical one when the value of the output of the integration circuit is equal to or exceeds an adjustable reference value. The outputs of the several threshold switches, each associated with an integrator and thereby with the like signal portions of the respective scanning line, are combined according to a logical OR operation in a logic circuit, the output of the logic circuit being used to drive a solenoid valve in order to reject material containing foreign bodies. The aforementioned apparatus and operation are repeated with at least one salient difference, the color of the conveyor belt, in order to enable removal of both light and dark foreign bodies.

16 Claims, 5 Drawing Figures

METHOD AND APPARATUS FOR SORTING FOREIGN BODIES FROM MATERIAL ON A MOVING CONVEYOR BELT

BACKGROUND OF THE INVENTION

The present invention relates to an apparatus and method for sorting foreign bodies from prime material, and more particularly to an apparatus and method for sorting foreign bodies from such prime material as raw tobacco or tobacco ribs wherein prime material on a moving conveyor belt is irradiated with visible and/or invisible light, the reflected light being picked up by an evaluating device in spatial or time sequence in the form of line areas moving at right angles to the direction of movement, said evaluating device integrating over time the signals obtained from several line areas and providing operating signals to an ejection device, the ejection device removing the detected foreign body from the prime material.

In a known method and apparatus as disclosed in U.S. Pat. No. 3,097,744 particles are removed from a flow of like particles, as contrasted with the removal of foreign bodies from a flow of different material. In particular, the entire width of the region traversed by the particles under investigation is scanned line by line. The individual signals obtained by optically scanning line by line are integrated to obtain a signal which, on rising above or dropping below a threshold value characteristic of the particles, brings about a discharge of unwanted particles from the particle flow.

Such an apparatus and method fail to function satisfactorily under certain conditions, for example particularly if the region under investigation is relatively wide or if a relatively large number of juxtaposed particles passes through this region. Unsatisfactory functioning results because only the small scanning area taken up by a particle to be removed contributes to the formation of an ejection signal, while the remaining, larger part of the overall scanning width contributes a signal which merely fluctuates to a greater or lesser extent about a mean value as a function of the noise. Even if the signals obtained in this way by line by line scanning are upslope integrated, in the presence of a particle to be ejected the total value obtained varies very slightly compared with a state in which no particle to be ejected is detected. This means that the method and apparatus are relatively insensitive or that extremely high quality signal evaluating devices must be used.

In another known apparatus disclosed in German OS 2,015,108, which operates in accordance with the same principle as the known apparatus described hereinbefore, individual mineral fragments successively drop past a camera tube, which records the reflections resulting from the illumination of the fragments and feeds them line by line to threshold circuits. The number of signals supplied by the threshold circuits is then a measure of the reflection behaviour of the mineral fragment surface and can be used for sorting particular mineral fragments from the flow of individual, successively following mineral fragments.

Thus, in this apparatus, only individual successively following particles are investigated and possibly removed and for the reasons indicated hereinbefore there is a considerable reduction in the sensitivity of this apparatus on changing to a larger number of juxtaposed particles or to a larger area scanning region.

Furthermore, a method and an apparatus are known, as disclosed in German Pat. No. 1,946,615, by means of which foreign bodies such as cigarette paper and lining paper fragments, filters and the like can be removed from pulled apart cigarette waste. To this end, groups of photocells are arranged above a conveyor belt on which the cigarette waste is conveyed and at right angles to the direction of movement thereof. Each of said photocells is allocated to a portion of the belt so that the entire belt width is scanned. The conveyor belt and the materials conveyed on it are illuminated in the vicinity of these photocell groups. The incident light is passed through color filters in order to block light having frequencies reflected by tobacco fibers (the prime material) and the conveyor belt, but admit light that is strongly reflected by the generally light foreign bodies to the corresponding photocells. The signals produced by illuminating the photocells are then supplied to electromagnets to activate ejection devices. The ejection devices are in the form of suction mechanisms covered by flaps, and are associated with the respective portions of the belt having an allocated photocell so that the detected foreign body or bodies can be removed.

This known method and apparatus, however, are suitable only for uses in which the foreign bodies have a much greater reflectivity than the prime material, particularly due to the fact that in this method the signals are obtained by evaluating the total brightness of a relatively large area of the conveyor belt and the materials located in this area.

SUMMARY OF THE INVENTION

An object of the present invention is to provide an apparatus and method for sorting foreign bodies from prime material having a significally improved sensitivity to effect a scanning of a relatively wide material flow with respect to the presence of relatively small foreign bodies.

According to the invention, the aforementioned disadvantages of the prior art are solved by an apparatus and method in which the line areas are subdivided into partial areas oriented at right angles to the direction of movement of the raw material to be sorted, each line area thereby being divided into sections, the thus formed line area sections of the individual partial areas being integrated separately from one another. By subdividing the width of the line area into partial areas, the line by line scanning operations taking place in the partial areas are integrated separately from one another, i.e. each partial area is individually scanned for the presence of a foreign body. Thus, if a foreign body is present in a partial area, a marked optical reaction is obtained from which is derived a characteristic signal. The remaining partial areas where there is no foreign body or into which the foreign body only slightly projects cause no optical reaction and no characteristic change to the signal. Since, in addition, the integration of the line area sections takes place separately, the evaluation of the optical reaction in the partial area containing the foreign body is not impaired by the signals of the partial areas without foreign bodies which only contain noise, so that a considerable increase in sensitivity is obtained. As a result, a relatively small foreign body or a foreign body whose reflection characteristics vary only relatively slightly from the prime material on the conveyor belt is reliably detected and can be ejected. Preferably, the values obtained after integrating a predetermined number of line area sections are cleared and then a predetermined number of line area sections are again integrated.

A particularly advantageous evaluation of the signals produced by a foreign body is obtained if only the alternating component of the signal supplied is integrated, because the noise components contained in the signal or those components resulting from the weak reflection of the material conveyed on the conveyor belt and the conveyor belt itself are compensated due to their statistical distribution and their positive and negative amplitudes, while essentially only the signals produced by the foreign bodies are amplified by integration.

According to a preferred embodiment of the invention, at least one light source provides illumination to an area of the conveyor belt and the material located on it, the evaluating device producing an operating signal that is a function of the reflected light, and an ejection device, controlled by the operating signal from the evaluating device, removes the detected foreign bodies from the raw material. The evaluating device of the preferred embodiment comprises a television camera arranged with its scanning line pattern at right angles to the direction of movement of the conveyor belt. The image components of the video signals from the television camera are supplied line by line to a multiplexer circuit for subdividing the image components of the video signals of the successively following lines into a plurality of signal portions. The signal portions are supplied to respective integration circuits as a function of their position within the scanning line, and the respective outputs of the integration circuits are coupled to a threshold value arrangement which supplies the operating signal. The blanking pulse of the television camera is preferably supplied to the multiplexer circuit as the timing signal.

Also according to the preferred embodiment of the invention, after evaluating the image components of the video signals of a predetermined number of scanning lines, the integration circuits can be reset for integrating the image components of the video signals of the same number of following lines.

In order to evaluate the respective output signals supplied by the individual integrating circuits, the threshold value arrangement preferably has a number of threshold switches, each of which is associated with a respective integration circuit. The thresholds of the threshold switches can be adjustable for adapting to different operating conditions.

Other objects, features and advantages of the present invention will become more fully apparent from the following detailed description of the various embodiments, the appended claims, and the accompanying drawings.

BRIEF DESCRIPTION OF THE DRAWINGS

In the drawings, where like numbers indicate like parts.

DETAILED DESCRIPTION OF THE PREFERRED EMBODIMENT

Figure 1:
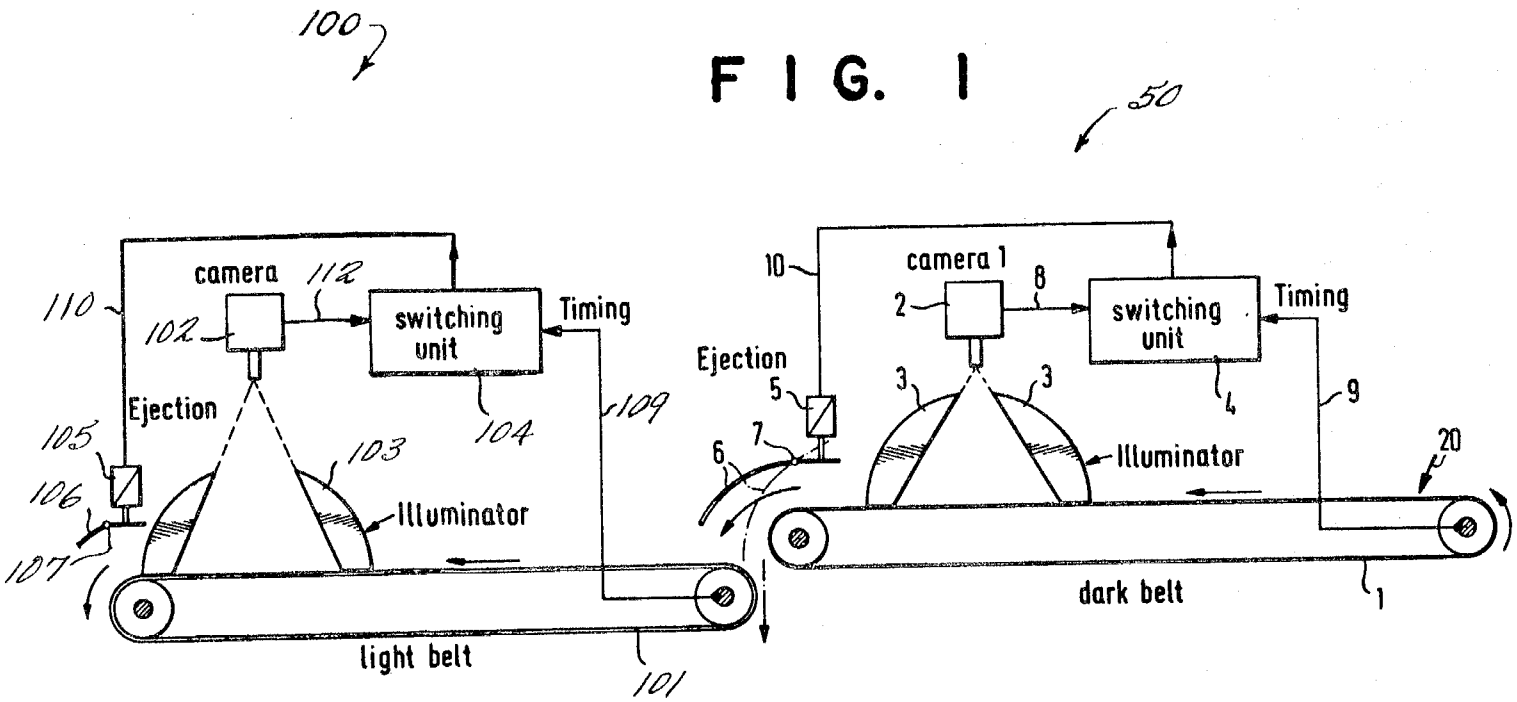
FIG. 1 is a pictorial-block diagram of an apparatus according to the preferred embodiment of the present invention wherein two evaluation systems are series-arranged relative to their respective conveyor belts.

In the preferred embodiments shown in FIG. 1, a conveyor belt 1 of an evaluation system 50 and a conveyor belt 101 of an evaluation system 100 are arranged in series so that the raw material, for example raw tobacco or tobacco ribs, conveyed by the conveyor belt 1 passes onto the conveyor belt 101. The two conveyor belts essentially differ only in that conveyor belt 1 is made from a dark material and conveyor belt 101 from a light material. Accordingly, evaluation system 50 is suitable for sorting light foreign bodies and evaluation system 100 for sorting dark foreign bodies. Hereinafter only the evaluation system 50 will be described in detail, it being understood that the construction and operation of the respective evaluation systems 50 and 100 are essentially similar.

The material is applied at position 20 to the upper side of the conveyor belt 1 (to the right in FIG. 1) in the form of a very thin layer. In the case of raw tobacco the leaves are completely separated so that foreign bodies remain masked only to the minimum extent practical. Equipment for applying material in this way is well known in the art and therefore is not described in detail.

Directly above a point close to the left-hand end area of conveyor belt 1 is an illuminating device 3, which contains for example fluorescent strip lights. It is used to illuminate the upper side of conveyor belt 1 and consequently the prime material and foreign bodies transported thereon. Because some type of foreign bodies are transparent plastic material which reflects virtually no visible light, a UV lamp (not shown) may also be used. A fluorescence of the transparent plastic foreign body is obtained when UV illumination is used, which can be evaluated in the same way as the reflected light of the fluorescent strip lights. It is to be understood that any illumination by which can be obtained an effect capable of being evaluated in the same way as the reflected light of the fluorescent strip is contemplated by the present invention.

In the vicinity of illuminating device 3, a television camera 2 is arranged above conveyor belt 1 and specifically in such a way that the scanning lines are perpendicular to the direction of movement of conveyor belt 1. The camera 2 is, for example, a conventional television camera having Plumbicon tubes with 312 or 313 scanning lines per frame and a scanning line duration of 64 microseconds.

Figure 2:
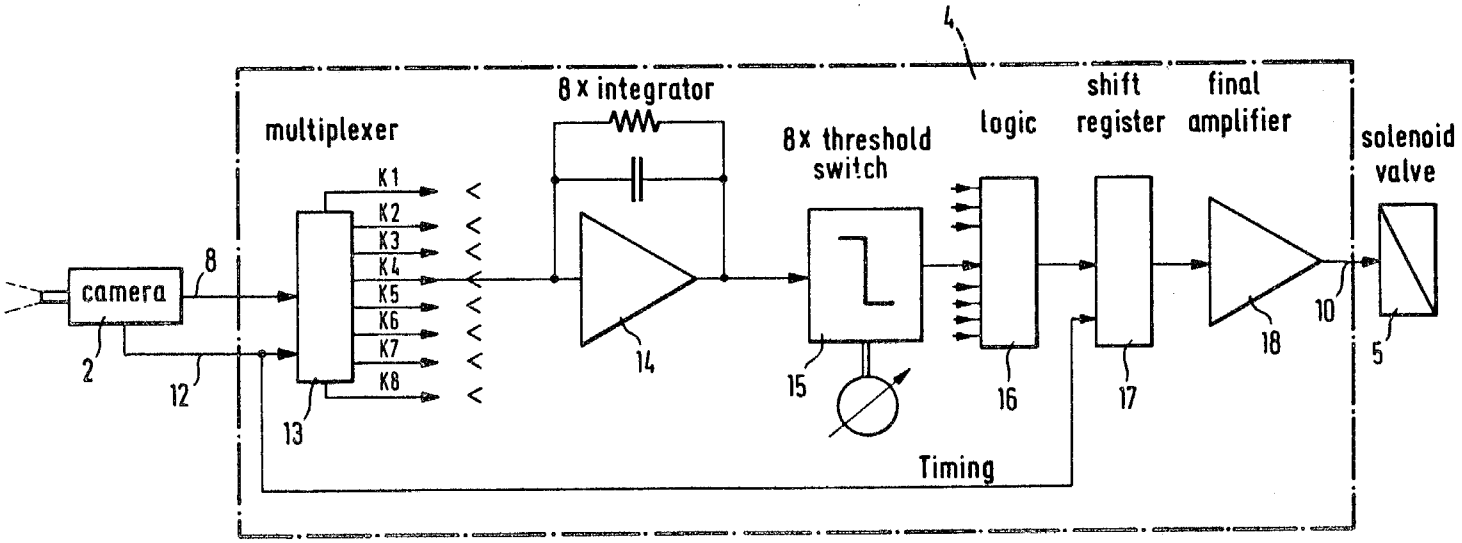
FIG. 2 is a block circuit diagram of an arrangement according to the preferred embodiment of the present invention for evaluating the video signals of the television camera.

The camera 2 is connected by means of a camera signal line 8 and a camera timing signal line 12 to a switching unit 4, described in FIG. 2, and from which a control line 10 leads to a solenoid valve 5 which, on activation, operates the ejection flap 6 which is pivotable about an axis 7. In the represented position this ejection flap passes the material from the conveyor belt 1 onto the conveyor belt 101. When activated by an appropriate control signal on control line 10, the solenoid valve flap 6 is pivoted about axis 7 in a counterclockwise direction, so that material striking the flap is directed between the conveyor belts 1 and 101. The ejection flap 6 is shown activated in phantom in FIG. 1. It is to be understood that the ejection flap 6 can also be operated in some other way, for example by means of pneumatically, mechanically or electronically operated and/or controlled devices.

A timing signal is obtained from the drive unit of the conveyor belt 1 for mutually relating the belt speed and the distance between the area scanned by the television camera 2 and the ejection area to one another for activating the ejection flap 6 at the correct time, i.e., when the material containing the foreign body which has been detected by the television camera has just reached the end of conveyor belt 1. The timing signal is supplied to switching unit 4 by means of a belt timing signal line 9, the switching unit 4 being adapted to control the operation of solenoid valve 5 via control line 10, as described above. Alternatively, or additionally, a predetermined delay may be built into the switching unit 4.

As has already been stated, evaluation system 100 is constructed in the same way as evaluation system 50 and a respective similar part is given a reference number equal to 100 plus the reference of the similar part in the evaluation system 50. Several differences are notable, however. A UV lamp need not be provided in illuminating device 103. The television camera 102 and switching unit 104 are regulated in such a way that they evaluate the appearance of dark foreign bodies. The conveyor belt 101 is a light color, as aforementioned.

In FIG. 2, the camera 2 is coupled to the solenoid valve 5 through switching unit 4, which is shown in detail therein. The television camera 2 is connected via the camera signal line 8 and the camera timing line 12 to a multiplexer 13 in the switching unit 4, the multiplexer 13 having 8 outputs K1–K8 to each of which is connected an integration circuit 14. To make it easier to understand the drawing, only the integration circuit 14 with its associated threshold switch 15 belonging to channel K4 as shown. Each integration circuit is connected to the input of a threshold switch, whose respective output signals are combined and evaluated in a logic circuit 16. The output of the logic circuit 16 is delayed by means of a series-connected shift register 17 in accordance with the conveyor belt movement speed and thereafter amplified in a final amplifier 18 for operating the solenoid valve 5.

The operation of the preferred embodiment of FIG. 2 now is explained with reference to FIG. 3. The camera 2 produces a negative image of the area illuminated by the illuminating device 3 and its white level is clamped in order to largely suppress within the camera the light normally reflected by the conveyor belt and the prime material, i.e., the camera has virtually no grey level.

Figures 3A, 3B, 3C:
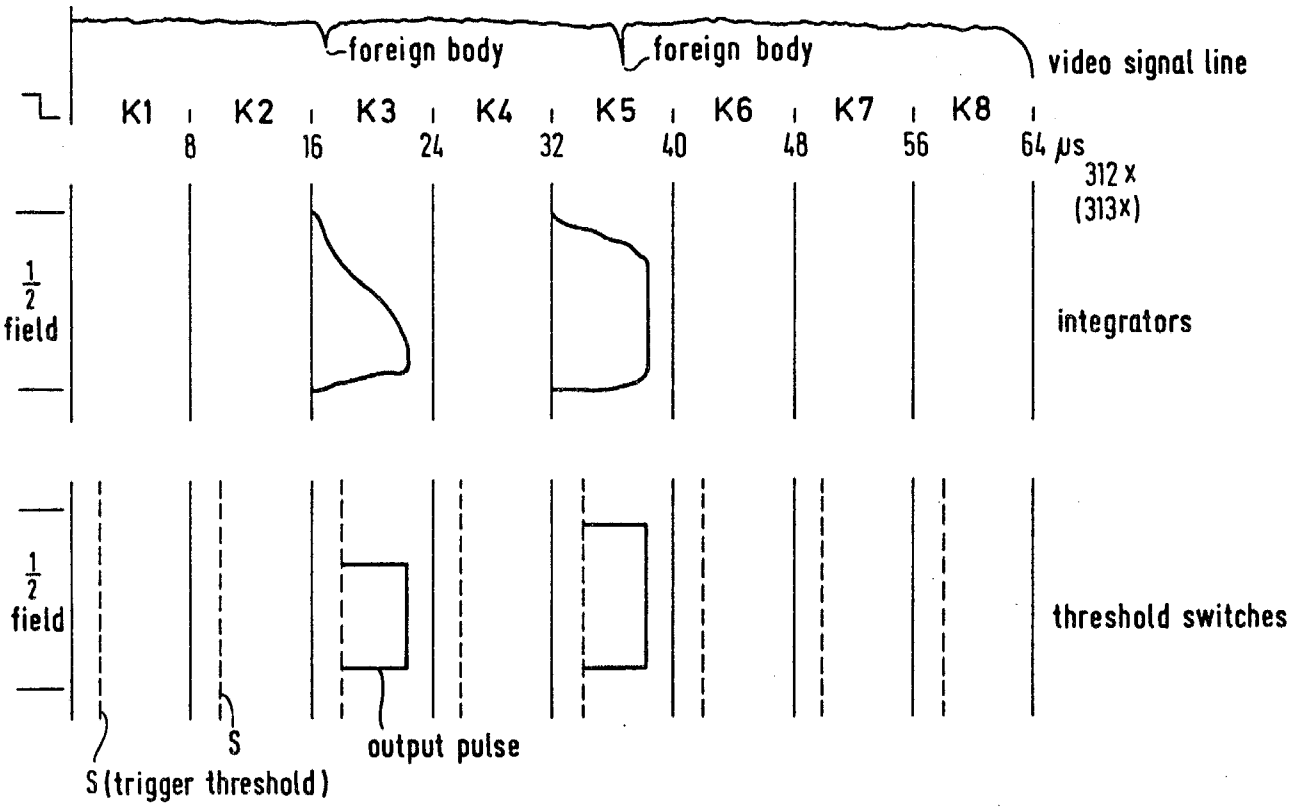
FIGS. 3A–3C show curves representative of the image component of a video signal and the output signals obtained therefrom of the integrating circuits and the threshold switch, respectively.

The image component of the video signal, a single scanning line of which is given as an example in FIG. 3A, pass via camera signal line 8 to multiplexer 13. The image component of the video signal of the individual scanning lines are successively supplied to multiplexer 13. This multiplexer is controlled via line 12 by timing pulses obtained from the scanning line blanking pulses of the television camera so that at its 8 outputs it supplies respective partial areas (K1–K8 in FIG. 3A) of a single scanning line signal, notably the same respective partial areas for all successive scanning lines at each corresponding multiplexer output. The multiplexer is well known to one skilled in the art and is, for example, a combination of segment counters type 4024 and segment switches type 4051 of the RCA Company.

The signals of the multiplexer outputs K1–K8 are supplied to respective integration circuits 14. Such an integrating circuit is well known to one skilled in the art and is, for example, a type LF 356 of the National Semiconductors Company. The input level to the integration circuit 14 is adjusted to the mean value of the image component of the video signal representing the absence of all foreign bodies. The portions of the image signals of successive lines of the television camera appearing at the individual multiplexer outputs are integrated over a period of time. As the input level of the integration circuit 14 is set to the mean value of the image component, the positive and negative components on average cancel one another out, while the signal components produced by respective foreign bodies are occurring in the form of negative pulses are not compensated but rather summed. Thus, a characteristic output signal (FIG. 3B) is obtained at the output of each respective integration circuit 14 to which foreign body signals are supplied. The characteristic output signal is absent in the case of integrating circuits to which no foreign body signal is supplied due to compensation of the image component. It is possible in this way to filter the foreign body signals from the image component of the video signal in order to be able to use them for operating the solenoid valve 5.

In this connection, it is pointed out that the respective integration circuits 14 integrate the image component of a predetermined number of scanning lines of the camera image, whereby this number is determined by counting the blanking pulses associated with the respective scanning lines. At the end of the predetermined number of scanning lines all the integrating circuits are simultaneously reset and a new integrating process starts for subsequent scanning lines.

As stated hereinbefore, FIG. 3A shows an exemplary image component of a video signal of a scanning line, a foreign body being indicated at approximately 18 microseconds and approximately 37 microseconds. The portions of the image component of the video signal including the foreign body indications are respectively provided at the multiplexer outputs K3 and K5 and are integrated to rough pulses by corresponding integration circuits 14, as shown in FIG. 3B.

The output signals of the respective integration circuits 14 are supplied to an associated threshold switch 15, whose threshold value is preferably adjustable for adapting to different operating conditions. The threshold value is designated by S in FIG. 3C. As the output signals of each integrating circuit 14 to which no foreign body indication has been supplied is essentially zero, the associated threshold switch 15 gives no output signal. Rough pulses are supplied to the respective threshold switches 15 associated with respective integration circuits 14 receiving a foreign body indication, as indicated in FIG. 3B. These pulses have an amplitude which is above the threshold value, and each respective threshold switch 15 so receiving such a rough pulse produces an output signal as shown in FIG. 3C and supplies it to the logic circuit 16. Any suitable commercially available circuit may be used as a respective threshold switch 15, including type LM 311 of the National Semiconductors Company.

As stated hereinabove, the output signals of the respective threshold switches 15 pass into logic circuit 16. Any suitable commercially available circuit may be used as the logic circuit 16, including for example a storage logic of type 4582 of the Harris Company. The output signals of the respective threshold switches 15 are combined by logic circuit 16 in the manner of an OR operation, as is well known in the art, and are supplied to the shift register 17, which brings about a signal delay corresponding to the speed of the conveyor belt 1 and the distance between the illuminated area of the belt and the ejection flap 6. Any suitable commercially available circuit may be used as the shift register 17, including for example the type 4031 of the RCA Corporation.

The shift register 17 supplies output signals at least for as long as foreign body indications appear in the image component of the video signal. The output signals from the shift register 17 are amplified by means of final amplifier 18, which may be any suitable commercially available circuit, including for example a type TIP 112 amplifier of Texas Instruments, and supplied to solenoid valve 5 which operates the ejection flap 6. The discharge of the material distributed over the entire width of the conveyor belt in the area in which the foreign bodies have been detected has proved to be more advantageous than the discharge of partial widths corresponding to the subdivision of the conveyor belt effected by the multiplexer 13, although it is to be understood that the present invention contemplates both methods of discharge and apparatus adapted to implement either method. However, the preferred embodiment in which the entire width of raw material is discharged avoids the possibility that detected foreign bodies will be conveyed on for further processing due to the fact that they have moved sideways after detection by the television camera and have consequently moved out of the previously detected partial area.

While the present invention has been described in connection with what is presently conceived to be the most preferred practical embodiment, it is to be understood that the present invention is not limited to the disclosed embodiment. There may be other embodiments, modifications and equivalent arrangements included within the spirit and scope of the appended claims, which therefore are to be appropriately interpreted.

What is claimed is:

1. A method for removing foreign bodies from material comprising the steps of:

moving said material along a given direction on a conveyor while exposing said material to light from a source;

successively detecting with a television camera light coming from said material, in response to exposure, in a plurality of line areas extending along a line perpendicular to said given direction of movement of said material and across said moving material;

separating the line areas extending along each line into a plurality of sections, each including a plurality of areas, said sections being divided along the direction of movement of said material;

sequentially integrating over time the signals associated with a plurality of successive and corresponding sections from successive lines, the result of said integration being cleared and said integration reinitiated periodically, for producing a plurality of operating signals, each indicating the presence or absence of a foreign body in the areas associated with the integrated signals; and removing each of said foreign bodies from said material in accordance with said operating signals.

2. The method as in claim 1 wherein during said step of sequentially integrating the integration of respective signals produces an operating signal having a zero value in the absence of a foreign body, and an operating signal having a non-zero value when a foreign body is present.

3. The method as in claim 1 further comprising the step of combining said operating signals obtained in accordance with a logical −OR operation, the result of said logical −OR operation being used to remove a part of said material, said part being material associated with said predetermined number of linear areas having at least one of said linear area sections indicative of the presence of a foregin body.

4. A method for removing foreign bodies from material comprising the steps of:

placing said material on a means having a first color for conveyance of said material along a given direction and for providing a color background of said first color;

exposing said material to light from a source;

successively detecting with a television camera light coming from said material, in response to exposure, in a plurality of line areas extending along a line, perpendicular to said given direction of movement of said material;

separating the line areas extending along said line into a plurality of sections each including a plurality of areas, said sections being divided along the direction of movement of said material;

sequentially integrating over time the signals associated with a plurality of successive and corresponding sections, from successive lines, the result of said integration being cleared and said integration reinitiated periodically, for producing a plurality of first operating signals, each indicating the presence or absence of a foreign body in the areas associated with the integrated signals;

removing in accordance with said first operating signals a first type of said foreign bodies, said first type causing a characteristic detection response when exposed upon a background of said first color, thereby providing once-sorted material;

placing said once-sorted material on a means having a second color for conveyance along said given direction and for providing a background of said second color;

exposing said once-sorted material to light from a source;

successively detecting with a television camera light coming from said once-sorted material, in response to exposure in a plurality of line areas extending along a line perpendicular to said given direction of movement of said once-sorted material;

separating the line areas extending along said line into a plurality of sections each including a plurality of areas, said sections being divided along the direction of motion of said material;

sequentially integrating over time the signals associated with a plurality of successive and corresponding sections from successive lines, the result of said integration being cleared and said integration reinitiated periodically, for producing a plurality or second operating signals, each indicating the presence or absence of a foreign body in the areas associated with the integrated signals; and removing in accordance with said second operating signal a second type of said foreign bodies, said second type causing a characteristic detection response when exposed upon a background of said second color.

5. The method as in claim 4 wherein said first color is a dark color and said second color is a light color.

6. The method as in claim 4 wherein said first color is a light color and said second color is a dark color.

7. An apparatus for removing foreign bodies from material comprising:

a conveyor for moving said material in a given direction;

a light source for illuminating said material as it moves along on said conveyor against a background surface;

a television camera for successively detecting reflected and radiant light from said material, in a plurality of line areas extending along a line perpendicular to said given direction of movement, said detection means providing a signal for each respective area indicative of the reflected light;

means for dividing said respective areas into a plurality of sections, each of said sections including a plurality of said areas;

means for sequentially integrating over time said received light signal of successive and corresponding sections from successive lines the result of said integration being cleared and said integration reinitiated periodically, for producing a plurality of operating signals; and means responsive to said operating signals for removing said foreign bodies in accordance therewith.

8. An apparatus for removing foreign bodies from material comprising:

means for conveying said material having a surface of a predetermined color for providing a background;

a light source for illuminating said material against said background;

a television camera having a plurality of scanning lines for detecting light from said material and for providing a video signal, said television camera being oriented for obtaining a perpendicular relationship between said scanning lines and the direction of motion of said conveying means surface, and said video signal having an image component indicative of said received light;

means for partitioning the image component associated with each scanning line into a plurality of signal portions and for providing each of said signal portions to a predetermined respective output thereof;

a plurality of integrating means, each associated with a respective output of said partitioning means, each effective to integrate successive signal portions, the result of said integration being cleared and said integration reinitiated periodically when a predetermined number of said signal portions are sequentially integrated, and each providing the result of said integration at the output thereof;

a plurality of threshold switching means, each associated with a predetermined one of said integrating means, for comparing the output of said integrating circuit with a reference value and providing a signal at the output thereof when the result of said integration is at least greater than said reference value;

means for combining the outputs of said plurality of threshold switching means to provide an operating signal;

means responsive to said operating signal for rejecting a first type and a second type of said foreign bodies, said first and second type when upon said background being capable of producing a characteristic image component of said video signal indicative of the presence of a foreign body.

9. The apparatus as in claim 8 wherein said light source includes fluorescent lights and wherein said light detected by said television camera includes reflected light when said first type is illuminated.

10. The apparatus as in claims 8 or 9 wherein said light source includes ultraviolet light and wherein said light detected by said television camera includes radiant light from a fluorescence of said second type of foreign body when said second type is illuminated.

11. The apparatus as in claim 8 wherein said predetermined color is a light color.

12. The apparatus as in claim 8 wherein said predetermined color is a dark color.

13. The apparatus as in claim 8 wherein said portioning means provides each of said signal portions to said predetermined respective output thereof in accordance with a blanking component of said video signal.

14. The apparatus as claim 8 wherein said reference value of each of said threshold means is individually adjustable.

15. The apparatus as in claim 8 wherein the input level of each of said integrating means is adjusted such that the integration of successive signal portions indicative of the absence of foreign bodies produces a signal having a value of zero, and the integration of successive signal portions indicative of the presence of foreign bodies produces a signal having a non-zero value.

16. The apparatus as in claim 8 wherein said combining means is a logical −OR gate.

* * * * *